US006540034B1

(12) United States Patent
Browne et al.

(10) Patent No.: US 6,540,034 B1
(45) Date of Patent: Apr. 1, 2003

(54) PORTABLE SEISMIC SHOTHOLE DRILLING SYSTEM

(75) Inventors: Noel Evan Browne, Houston, TX (US); Gerard Thomas Pittard, Houston, TX (US)

(73) Assignee: Westerngeco L.L.C., Houston, TX (US)

( * ) Notice: Subject to any disclaimer, the term of this patent is extended or adjusted under 35 U.S.C. 154(b) by 0 days.

(21) Appl. No.: 09/561,768

(22) Filed: Apr. 29, 2000

(51) Int. Cl.[7] ..... E21B 4/06

(52) U.S. Cl. ..... 175/320; 175/325.2; 175/293

(58) Field of Search ..... 175/320, 293, 175/296, 299, 302, 325.2; 73/122, 90, 131, 144

(56) References Cited

U.S. PATENT DOCUMENTS

| | | | | | |
|---|---|---|---|---|---|
| 2,754,085 | A | | 7/1956 | Sewell et al. | 255/22 |
| 3,032,129 | A | | 5/1962 | Fletcher et al. | 175/320 |
| 3,570,608 | A | * | 3/1971 | Erma | 173/201 |
| 3,599,730 | A | * | 8/1971 | Luthman et al. | 173/73 |
| 3,807,512 | A | * | 4/1974 | Pogonowski et al. | 175/106 |
| 4,312,412 | A | * | 1/1982 | Pillow | 173/17 |
| 4,474,248 | A | * | 10/1984 | Musso | 173/17 |
| 4,819,746 | A | * | 4/1989 | Brown et al. | 175/296 |
| 5,515,932 | A | * | 5/1996 | Lazarus et al. | 175/50 |

FOREIGN PATENT DOCUMENTS

| | | |
|---|---|---|
| DE | 528 577 | 1/1932 |
| DE | 196 47 575 | 11/1997 |
| EP | 0 141 117 | 5/1985 |
| EP | 0 332 328 | 9/1989 |
| GB | 1071418 | 6/1967 |
| WO | WO98/12410 | 3/1998 |

OTHER PUBLICATIONS

EP 01 30 3879, European Search Report (Aug. 14, 2001).

* cited by examiner

*Primary Examiner*—Frank S. Tsay
(74) *Attorney, Agent, or Firm*—David S. Figatner; Williams, Morgan & Amerson, P.C.

(57) ABSTRACT

A portable apparatus for creating holes in rock. A rock drill connected to a compressed air supply is engaged with a connector attached between the rock drill and a rock bit. The connector has a substantially tubular shaft for transporting compressed air from the air supply to the rock bit. The tubular shaft uniquely maximizes the air available for removing rock cuttings and minimizes the possibility of rock bit sticking in the rock hole. The invention is particularly suited to seismic shothole drilling requiring portable equipment operable by a single person.

16 Claims, 3 Drawing Sheets

PORTABLE SEISMIC SHOTHOLE DRILLING SYSTEM

BACKGROUND OF THE INVENTION

The present invention relates to the field of small diameter holes drilled in hard geologic formations such as rock. More particularly, the invention relates to a portable apparatus for efficiently creating holes such as seismic shotholes in rock.

Rock holes are drilled for excavation blasting, mining operations, and many other purposes. For example, explorative searches for hydrocarbons, minerals, and other products require the physical penetration of geologic formations. Seismic operations typically detonate explosive charges to generate shock wave source signals for penetrating subsurface geologic formations. The shock waves are reflected from subsurface geologic structures and interfaces and the reflected energy is detected with sensors such as geophones at the surface. Transducers reduce the reflected energy into signals which are recorded for processing.

In many land-based geophysical seismic operations, vibrator trucks contact the soil and discharge energy into subsurface geologic formations. However, survey regions frequently comprise mountainous, tropical, or other regions inaccessible to seismic trucks. Because of accessibility constraints and the large source energy provided by explosive materials, explosive charges detonated in shot-holes provide a preferred source of seismic source energy. Shot holes up to four wide and between ten and thirty meters deep are drilled in surface geologic formations. Explosive charges are placed in the bottom of the shot-hole and are detonated to generate shock waves transmitted into the subsurface geologic formations.

Seismic shot-holes require different parameters than excavation blast holes because the objective of shot-holes is not to displace or fracture rock, but to efficiently transfer elastic shock wave energy downwardly into subsurface geologic formations. Accordingly, shot-hole equipment and drilling techniques are relatively specialized. As representative examples, U.S. Pat. No. 3,939,771 to McReynolds (1976) disclosed a seismic explosive charge loader and anchor. U.S. Pat. No. 4,278,025 to McReynolds (1981) disclosed a seismic explosive charge loader having a spring anchor for retaining the charge in the borehole. U.S. Pat. No. 4,546,703 to Thompson (1985) disclosed a device for placing an explosive charge into a borehole. U.S. Pat. No. 4,660,634 to Johnson, Jr. (1987) disclosed an automatic drill pipe breakout especially suited for geophysical seismic drilling. U.S. Pat. No. 5,281,775 to Gremillion (1994) disclosed a vibration hole forming device for shot-hole drilling from a lightweight drill.

The diameter of conventional explosive charges is smaller than the shot-hole diameter to facilitate placement of the explosives into the lower shot-hole end. The resulting annulus between the explosive charge and the shot-hole wall does not efficiently couple the shock wave energy to the subsurface geologic formations. Moreover, a large portion of the shock wave energy is discharged upwardly through the shot-hole because of the relatively low resistance provided by the open hole. To limit this energy loss, plugs are placed in the shot-hole as shown in U.S. Pat. No. 4,066,125 to Bassani (1978). U.S. Pat. No. 4,736,796 to Arnall et al. (1988) disclosed other techniques for sealing shot-holes with cement, gravel, and bentonite.

Hard rock drills use compressed air to drive a hammer in mining and tunneling operations. A rotary percussion hammer drives a narrow, hexagonal shaped bit into the rock to pulverize the rock and to create the rock hole. Such drills are not useful at distances from the rock surface because such drills jam within the rock hole and become stuck. This sticking is caused by variations in the hole annular area due to the hexogonal bit shape, by the tendency for rock particles to lodge against the exterior bit edges, and by insufficient airflow velocity through the hexagonal bit. The failure to remove rock particles from the hole generated increases the probability of bit sticking within the hole and the loss in efficiency caused by such factors.

Regional seismic operations require multiple shothole locations for a seismic survey, and large surveys can require thousands of shotholes. The average cost for each shothole multiplied by the number of shotholes significantly determines the economic efficiency of the survey and the data sets obtainable from a survey design. A need exists for improved techniques for efficiently creating holes such as seismic shotholes in areas inaccessible by heavy equipment.

SUMMARY OF THE INVENTION

The present invention provides an apparatus engagable with a portable rock drill and compressed air supply for forming a hole in rock. The apparatus comprises a rock bit having a selected radial dimension for breaking the rock into rock cuttings to form the rock hole, a connector attached to the bit and to the rock drill wherein the connector includes a substantially tubular shaft having an exterior radial dimension less than the selected radial dimension of the rock bit, and an aperture through the connector for receiving compressed air from the rock drill and for conveying the compressed air to the rock bit for transporting rock cuttings from the rock hole.

In different embodiments of the invention, the connector can include a tool adapter having a port for receiving a compressed air supply, a drill pipe body attached to the tool adaptor, or a tool crossover for attaching a drill pipe body to a tool adaptor, or a drill pipe end for attachment to the rock bit.

DESCRIPTION OF THE PREFERRED EMBODIMENTS

The invention provides a unique portable system for forming holes in hard geologic formations such as rock. As used herein, the term "rock" means any geologic formations having tough or hard particles difficult to penetrate with a drill, and includes aggregates, agglomerates, hard rock, clays, gravel deposits, and similar formations.

Figure 1:
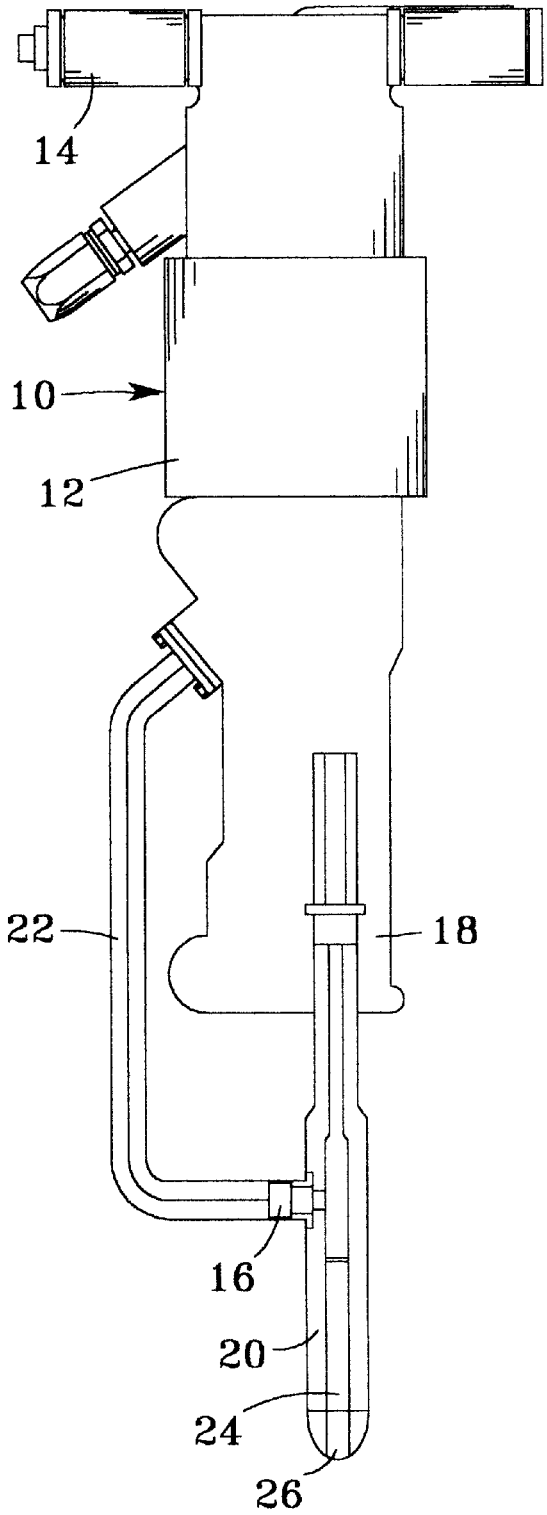
Fig. 1 Prior Art
FIG. 1 illustrates a conventional hexagonal rock bit and rotary percussion drill.

FIG. 1 illustrates a conventional rotary percussion drill such as rock drill 10 having drill body 12, handle 14, air hose swivel housing 16, bit chuck 18, and drill bit 20. Compressed air enters air hose 16 to rotate or reciprocate bit 20, and is partially routed through hose 22 to enter aperture 24 through bit 20. Such air travels through aperture 24 and is discharged through port 26 to clean bit 20 and to transport rock cuttings from the hole formed in the rock by bit 20. As previously discussed, conventional drill bits such as bit 20 are hexagonal and have a relatively small aperture 24 therethrough for discharging compressed air through port 26.

Figure 2:
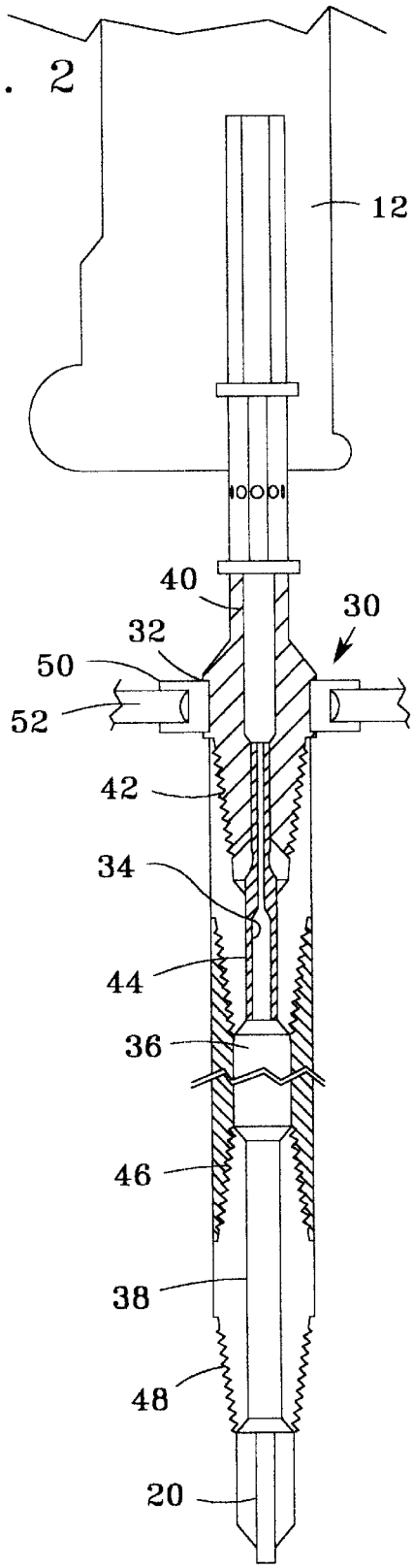
FIG. 2 illustrates a connector attached to a drill body and drill bit.

FIG. 2 illustrates one embodiment of the invention wherein connector 30 is attached to drill body 12-and to drill bit 20. As illustrated in FIG. 2, connector 30 includes tool adapter 32, bit crossover 34, drill pipe body 36, and drill pipe end 38 connected with threaded connections or threadforms 40, 42, 44, 46 and 48. Tool adapter 32 is connected to drill body 12 with threadform 40, bit crossover 34 is connected to tool adapter 32 with threadform 42, drill pipe body 36 is connected to bit crossover 34 with threadform 44, drill pipe end 38 is connected to drill pipe body 36 with threadform 46, and bit 20 is connected with a threadform 48 to drill pipe end 38.

Figure 3:
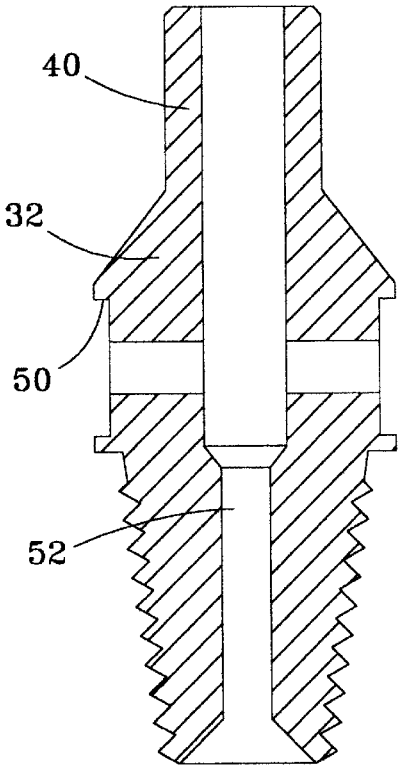
FIG. 3 illustrates a tool adapter.
Figure 4:
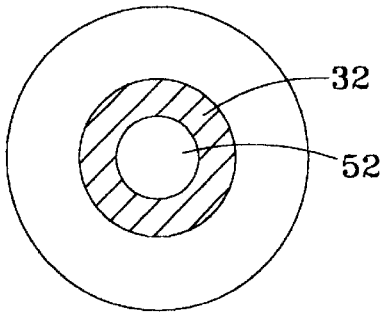
FIG. 4 illustrates a sectional view showing the relative diameter of tool adapter and the aperture.
Figure 5:
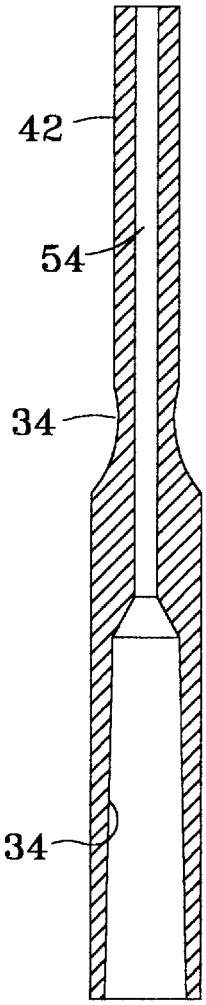
FIG. 5 illustrates bit crossover attachable to a tool adapter and a drill pipe body.

FIG. 3 illustrates one embodiment of tool adapter 32 engagable with drill body 12. Tool adapter 32 includes swivel connection 50 for connection with air hose 16 and aperture 52 for transporting compressed air therethrough. FIG. 4 illustrates a sectional view wherein the diameter of tool adapter 32 is shown and the size of aperture 52 is illustrated. FIG. 5 illustrates bit crossover 34 attachable to tool adapter 32 with threadform 42 and attachable to drill pipe body 36 with threadform 44. Aperture 54 through bit crossover 34 is aligned with aperture 52 for transporting compressed air therethrough.

Figure 6:
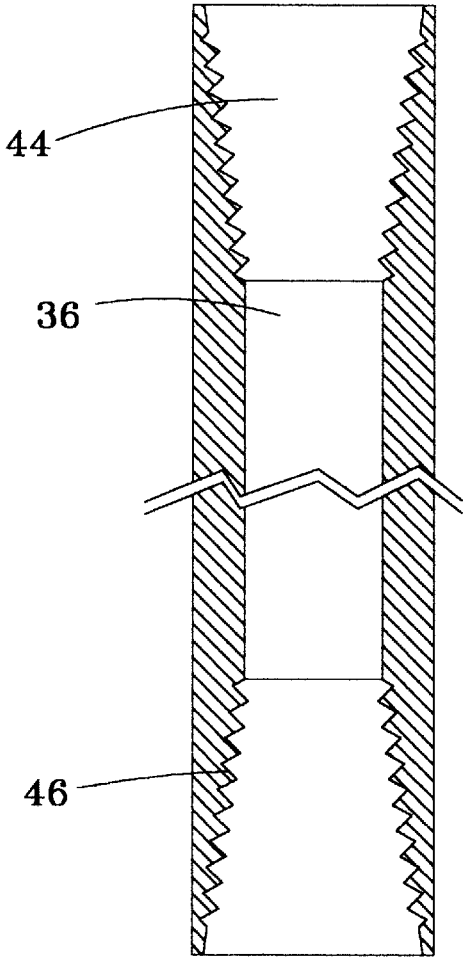
FIG. 6 illustrates a drill pipe body attached to a bit crossover and drill pipe end.
Figure 7:
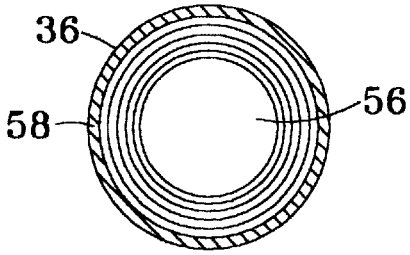
FIG. 7 illustrates a crossectional view of a drill pipe body.

FIG. 6 illustrates drill pipe body 36 having threadform 44 for engagement with bit crossover 34 and having threadform 46 for engagement with drill pipe end 38. A crossectional view of drill pipe body 36 is illustrated in FIG. 7, wherein the size of aperture 56 through drill pipe body 36 and the structure of exterior surface 58 is) shown. Drill pipe body 36 preferably comprises substantially the entire length of connector 30 and provides several important functions. Drill pipe body 36 must be sufficiently strong to transmit significant impact forces from drill body 12 to bit 20. Additionally, drill pipe body 36 is preferably cylindrical to eliminate edges susceptible to entrapment of rock cuttings. By providing a smooth profile on the exterior surface 58, the likelihood of rock cuttings binding between exterior surface 58 and the interior surface of the hole drilled in the rock is reduced because there are no edges or discontinuities to interrupt the fluid flow. This configuration facilitates a relatively smooth laminar flow of compressed air around exterior surface 58, which increases the probability of laminar flow for the rock cuttings entrained within such compressed air.

By providing a cylindrical aperture 56 through drill pipe body 36, the relative size of aperture 56 can be maximized relative to the radial diameter of exterior surface 58. This configuration uniquely provides an efficient relationship which maximizes the amount of compressed airflow possible through connector 30. By providing optimal compressed air flow, rock cuttings are efficiently removed from the rock hole and the pos sibility of binding between the rock hole side wall and bit 20 is significantly reduced.

Drill pipe end 38 is attached to drill pipe body 36 with threadform 46 and to bit 20 with threadform 48, and aperture 60 extends the compressed air path to bit 20 and port 26. Although drill pipe end 38 is illustrated as having two male threadform ends, such connections can be male, female, snap-locked, or engaged as other mechanical connector types. The configuration of the invention permits alternative materials such as aluminum to be used in drill pipe body 36, thereby facilitating manufacture and increasing the relative diameter of aperture 56 relative to the diameter of exterior surface 58.

The invention significantly improves the performance of rock hole formation by portable drills manually operable by a single person. The invention is more efficient than hexagonal drills conventionally used in hard rock drilling. Drill bit 20 is attached to a cylindrical drill pipe end 38 and drill pipe body 36 which is slightly smaller in radial dimension than the gauge of bit 20. This configuration provides a relatively small annulus between exterior surface 58 and the rock wall of the hole, and maximizes the internal size of aperture 56 and the quantity of compressed air transportable therethrough at a given pressure. By making such annulus smaller and more uniform in dimension, and by increasing the volume of compressed air transported to the bottom of the rock hole formed by bit 20, the annular velocity of rock cuttings is increased. This increased rock cutting velocity reduces the possibility that rock cuttings will be drawn by gravity to the bottom of the rock hole, when such cuttings would cause "binding" or "sticking" between exterior surface 58 and the rock wall. By reducing the possibility of rock cutting build-up around exterior surface 58, overall drilling efficiency is increased.

Although the invention has been described in terms of certain preferred embodiments, it will become apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. An apparatus engagable with a portable rock drill and compressed air supply for forming a hole in rock, comprising:

a rock bit having a selected radial dimension for breaking the rock into rock cuttings to form the rock hole;

a connector attached to said bit and to the rock drill, wherein said connector includes a substantially tubular shaft having an exterior radial dimension less than the selected radial dimension of said rock bit; and an aperture through said connector for receiving compressed air from said rock drill and for conveying the compressed air to said rock bit for transporting rock cuttings from the rock hole.

2. An apparatus as recited in claim 1, wherein the thickness of said tubular shaft is minimized to increase the volume of air flowing through said aperture while increasing the velocity of air flowing in the annulus between said tubular shaft and the rock hole.

3. An apparatus as recited in claim 1, wherein said connector comprises a tool adapter for engagement with the rock drill and further comprises a drill pipe body attached to said tool adapter and to said rock bit.

4. An apparatus as recited in claim 3, wherein said tool adapter includes a port for receiving compressed air and for communicating such compressed air to said aperture.

5. An apparatus as recited in claim 3, further comprising a bit crossover attached between said tool adapter and said drill pipe body.

6. An apparatus as recited in claim 3, further comprising a drill pipe end attached between said drill pipe body and said rock bit.

7. An apparatus as recited in claim 1, wherein said aperture is cylindrical.

8. An apparatus as recited in claim 1, wherein said rock bit is capable of forming a seismic shothole in the rock.

9. An apparatus engagable with a compressed air source for generating a seismic shothole in rock, comprising:

a rock drill attachable to the compressed air source;

a bit having a selected radial dimension for breaking the rock into rock cuttings to form the shothole;

a connector attached to said bit and to said rock drill, wherein said connector includes a substantially tubular shaft having a radial dimension less than the selected radial dimension of said rock bit; and an aperture through said connector for receiving compressed air from said rock drill and for conveying the compressed air to said rock bit for transporting rock cuttings from the shothole.

10. An apparatus as recited in claim 9, wherein the thickness of said tubular shaft is minimized to increase the volume of air flowing through said aperture while increasing the velocity of air flowing in the annulus between said tubular shaft and the shothole.

11. An apparatus as recited in claim 9, wherein said connector comprises a tool adapter for engagement with the rock drill and further comprises a drill pipe body attached to said tool adapter and to said rock bit.

12. An apparatus as recited in claim 9, wherein said aperture is cylindrical.

13. An apparatus as recited in claim 9, wherein said apparatus is portably operable by one person.

14. An apparatus as recited in claim 9, wherein the crossectional area of said aperture exceeds the crossectional area of the annulus between said connector and the shothole wall by at least a factor of two.

15. An apparatus as recited in claim 9, wherein the crossectional area of said aperture exceeds the crossectional area of the annulus between said connector and the shothole wall by at least a factor of three.

16. An apparatus as recited in claim 9, wherein the thickness of said tubular shaft is equal to or less than 0.30 inches.

* * * * *